US006892730B2

(12) United States Patent
Griffiths

(10) Patent No.: US 6,892,730 B2
(45) Date of Patent: May 17, 2005

(54) HIGH G OXYGEN MASK FOR AIRCREW

(76) Inventor: Joseph Anthony Griffiths, Mid Trees Lythe Lythe Hill Estate Petworth Road, Hazlemere, Surrey (GB)

( * ) Notice: Subject to any disclaimer, the term of this patent is extended or adjusted under 35 U.S.C. 154(b) by 55 days.

(21) Appl. No.: 10/665,987

(22) Filed: Sep. 18, 2003

(65) Prior Publication Data

US 2004/0112386 A1 Jun. 17, 2004

(30) Foreign Application Priority Data

Sep. 18, 2002 (GB) ..... 0221687

(51) Int. Cl.[7] ..... A62B 18/08
(52) U.S. Cl. ..... 128/206.24; 128/205.25
(58) Field of Search ..... 128/205.25, 206.15, 128/206.21, 206.24, 206.26, 207.12, 201.19, 202.27, 207.11

(56) References Cited

U.S. PATENT DOCUMENTS

| | | | | | |
|---|---|---|---|---|---|
| 3,513,841 | A | * | 5/1970 | Seeler | 128/146.7 |
| 4,069,516 | A | * | 1/1978 | Watkins, Jr. | 2/428 |
| 4,677,977 | A | * | 7/1987 | Wilcox | 128/206.24 |
| 5,349,949 | A | * | 9/1994 | Schegerin | 128/206.24 |
| 5,353,789 | A | * | 10/1994 | Schlobohm | 128/206.24 |
| 5,355,878 | A | * | 10/1994 | Griffiths et al. | 128/206.24 |
| 5,649,532 | A | * | 7/1997 | Griffiths | 128/206.24 |
| 6,629,531 | B2 | * | 10/2003 | Gleason et al. | 128/205.25 |
| 2004/0107968 | A1 | * | 6/2004 | Griffiths | 128/206.21 |

FOREIGN PATENT DOCUMENTS

| | | | |
|---|---|---|---|
| GB | 2262239 | A | 6/1993 |
| GB | 2266669 | A | 11/1993 |
| GB | 2275614 | A | 9/1994 |
| WO | WO 92/00120 | A1 | 1/1992 |

* cited by examiner

*Primary Examiner*—Henry Bennett
(74) *Attorney, Agent, or Firm*—Lowrie, Lando & Anastasi, LLP

(57) ABSTRACT

A flexible oro-nasal mask for mounting in a rigid shell attached to the helmet of aircrew at a fixed distance therefrom. The flexible oro-nasal mask incorporates an inspiratory and expiratory valve and the periphery of the mask is adapted to make a seal with the pilot's face. The oro-nasal mask includes an extendable structure which presses the periphery of the mask automatically towards the pilot's face to improve the seal therewith when gas at a pressure above that required for normal breathing is supplied to the mask. The extendable structure is configured so that when gas at a high pressure is supplied to the interior of the mask, the portion in the bottom region of the mask extends more than the portion in the upper region of the mask and the bottom of the mask is moved away from the wearer's face by a greater amount in the chin region than the nose region and the mask pivots upwardly automatically to compensate for the effects of G thereon. One embodiment of an extendable structure comprises an annular inwardly directed re-entrant recess formed in the wall of the mask adjacent the peripheral seal, the depth of said recess in the bottom half of the mask being greater than the depth in the top half thereof.

11 Claims, 3 Drawing Sheets

HIGH G OXYGEN MASK FOR AIRCREW

RELATED APPLICATIONS

Foreign priority benefits are claimed under 35 U.S.C. §119(a) of United Kingdom application number 0221687.7, filed Sep. 18, 2002 and titled "High G Oxygen Mask for Air crew."

BACKGROUND OF INVENTION

1. Field of Invention

This invention relates to an oxygen mask for use by pilot's, and more particularly to an oxygen mask for use by pilot's who are subjected to high G forces.

2. Discussion of Related Art

Breathing equipment for air crew normally comprises a flexible face mask having an inspiratory valve supplied with oxygen or some other breathable gas and an expiratory valve to allow the pilot to expel the air from the mask on exhalation. The face mask is attached to the pilot's flying helmet by means of a harness incorporating a releasable fitting.

In fighter aircraft, it is essential that the face mask makes a seal with the pilot's face at all times. Under normal flying conditions, this is not a problem as the pilot adjusts the harness tension so that the mask makes the necessary seal with his face and is also comfortable to wear. The supply of the breathable mixture through the mask is controlled by a breathing gas regulator which is responsive to the G-forces that it is subjected to. In other words, when the G-force increases, the pressure of the gas supply to the interior of the mask is correspondingly increased and vice-versa. Thus, changes in the G-forces applied to the regulator controlling the breathable gas supply result in automatic changes in pressure in the interior of the mask. It will be appreciated that unless some means is provided to maintain the seal between the mask and the pilot's face, any substantial increase in pressure within the mask cavity can cause the mask seal to leak so that the pilot will not receive the pressure of breathable gas he requires and he could therefore black out.

One known way of overcoming this problem has been to include an over-centre toggle in the harness assembly which attaches the mask to the pilot's helmet. This toggle is in a low-tensioned position for normal flight but, when the pilot wants to make a tight turn, he moves the toggle into its high tensioned position before the makes the turn which causes the face mask to be drawn more tightly against his face thereby improving the seal therewith.

After the turn is completed, he then releases the toggle. Indeed, he has to do this because the pressure exerted on his face when the toggle is engaged is so great that the mask is very uncomfortable to wear. The main problem with this arrangement is that the pilot must remember to engage the toggle before he makes a turn (possibly difficult in a combat situation) and release it after the turn has been completed as the pressure on his face is too high to be comfortable for normal flying.

In order to overcome these problems, the face mask disclosed in European patent No. 0541549 was developed and a breathing apparatus was provided in which the oro-nasal mask was mounted in a rigid shell attached to the pilot's helmet at a fixed distance therefrom, the oro-nasal mask including extendable means operable to cause the oro-nasal mask or a portion thereof to move automatically relative to the pilot's face to vary the seal therewith dependent on the pressurized breathable gas supplied to the mask.

In one embodiment of the mask in said earlier patent, the extensible means is an inflatable bladder located between the oro-nasal mask and the rigid shell. In another embodiment, the extensible means is located in the wall of the oro-nasal mask and comprises one or more folds or bellows. In both embodiments, when breathable gas at a pressure above that needed for normal breathing is supplied to the bladder or the interior of the oro-nasal mask, the bladder inflates or the bellows or folds extend to move the mask relative to the rigid shell in which it is mounted and thereby automatically vary the pressure of the mask on the pilot's face and its seal therewith dependent on the pressure of the breathable gas supplied to it. The essence of this solution is that the position of the rigid shell in which the oro-nasal mask is mounted and maintained at a fixed distance from the pilot's face and helmet so that the mask can be made to move relative to this fixed shell and therefore relative to the pilot's face to vary the seal the mask makes therewith dependent on the breathable gas pressure supplied to the mask.

SUMMARY OF THE INVENTION

A first aspect of the invention is directed to a flexible oro-nasal mask for mounting in a rigid shell attached to a helmet of air crew at a fixed distance therefrom, the flexible oro-nasal mask comprising an inspiratory and expiratory valve and a periphery of the mask being adapted to make a seal with a wearer's face, the oro-nasal mask comprising: an extendable means operable to press the periphery of the mask automatically towards the wearer's face to improve the seal therewith when gas at a pressure above that for normal breathing is supplied to the mask and the extendable means reconfigured as a result thereof, the extendable means being configured so that when the gas is supplied to an interior of the mask, a portion thereof in a bottom region of the mask extends more than a portion in an upper region of the mask so that the bottom of the mask is moved away from the wearer's face by a greater amount in a chin region of the wearer's face than in the nose region of the wearer's face, whereby the mask is capable of pivoting upwardly automatically to compensate for effects of G forces.

In some embodiments, the extendable means comprises an annular inwardly directed re-entrant recess formed in a wall of the mask adjacent the periphery, a depth of said recess in the bottom half of the mask being greater than a depth in the top half thereof. Optionally, the re-entrant recess is V-shaped and comprises an inwardly directed flange on a front portion of the mask which is attached to a correspondingly dimensioned inwardly directed flange adjacent the periphery on a separate rear portion of the mask.

In some embodiments, the extendable means comprises a plurality of annular inwardly directed recesses formed in a wall of the mask to provide a bellows therein.

In other embodiments, the wall of the mask includes a convoluted rolling section, a thickness of the mask wall in a region of the convoluted rolling section being less than a thickness of the mask in a remainder of the mask thereby allowing the mask to be rolled back on itself into an S-shaped configuration.

A second aspect of the invention is directed to a breathing apparatus for use with a helmet, comprising: (A) a rigid shell; (B) an inspiratory valve; and (C) a flexible oro-nasal mask coupled to the rigid shell and coupled to the inspiratory valve, and having a chin region, a nose region, and a periphery adapted to make a seal with a human face, the flexible oro-nasal mask being adapted to reconfigured as a result of gas at a pressure above that for normal breathing being supplied to an interior of the mask through the inspiratory valve, such that a portion of the oro-nasal mask in the chin region extends further from the helmet than a portion of the oro-nasal mask in the nose region; whereby the periphery automatically presses against a wearer's face to improve the seal therewith, and the mask pivots upwardly automatically to compensate for the effects of G forces.

In some embodiments, the flexible oro-nasal mask comprises an annular inwardly directed re-entrant recess formed in a wall of the mask adjacent the periphery, a depth of said recess in a bottom half of the mask being greater than a depth in a top half thereof. Optionally, the re-entrant recess is V-shaped and comprises an inwardly directed flange on a front portion of the mask which is attached to a correspondingly dimensioned inwardly directed flange adjacent the periphery on a separate rear portion of the mask.

In some embodiments, the flexible oro-nasal mask comprises a plurality of annular inwardly directed recesses formed in the a wall of the oro-nasal mask to provide a bellows therein. In other embodiments, a wall of the oro-nasal mask includes a convoluted rolling section, a thickness of the oro-nasal mask wall in a region of the convoluted rolling section being less than a thickness of a remainder of the mask thereby allowing the mask to be rolled back on itself into an S-shaped configuration. In some embodiments, the breathing apparatus further comprises an attachment to maintain the mask a fixed distance from the helmet.

BRIEF DESCRIPTION OF THE DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
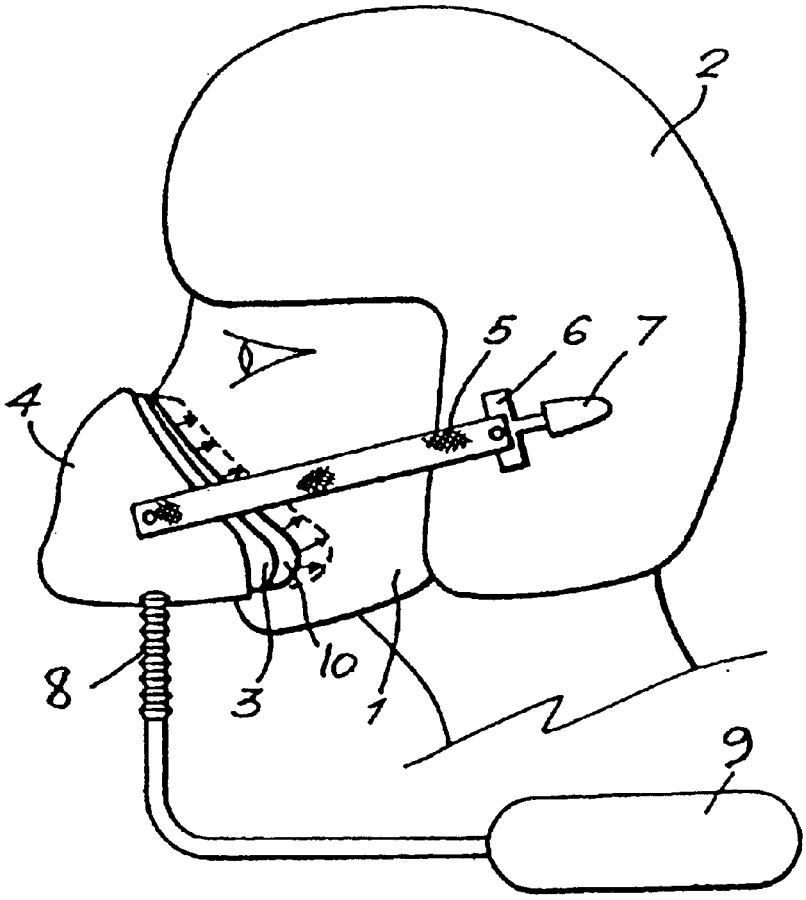
FIG. 1 is a side view of a prior art face mask in use with an air crew helmet and breathable gas supply.

Referring now to the drawings, FIG. 1 shows a pilot 1 wearing a rigid protective helmet 2. A flexible oro-nasal mask 3, usually made of a natural synthetic rubber, surrounds the pilot's nose and mouth and is mounted in a rigid plastics shell 4 attached to the helmet 2 by means of harness arrangement 5 which includes adjustable means (not shown) so that'its length can be readily altered to ensure that the oro-nasal mask 3 rests comfortably on the pilot's face with its peripheral edge 10 making a proper seal with the area of the pilot's face surrounding his nose and mouth. It should be noted that the harness 5 is made of an in extensible material such as webbing or a metal wire mounted at mounting point P to the rigid shell 4 and at its opposite end in mounting 7 so that when the shell 4 and mask 3 are in position on the pilot's face, the position of the shell 4 relative to the helmet 2 cannot change and it remains at a fixed distance D therefrom (see FIGS. 2A and 2B).

A breathable gas such as oxygen is supplied to the interior of the mask 3 from an oxygen regulator 9 through hose 8.

Inspiratory and expiratory valves (not shown) are provided in the mask 3 in known manner.

Figure 2A:
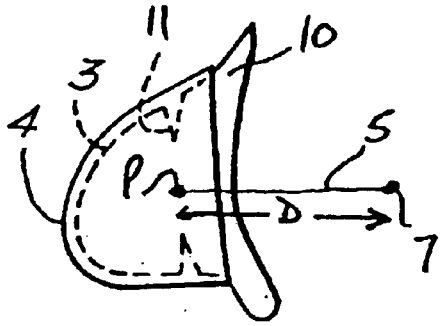
FIG. 2A is a schematic view, on an enlarged scale, of part of the face mask shown in FIG. 1, the oro-nasal mask mounted in the rigid shell being shown in dotted lines.
Figure 2B:
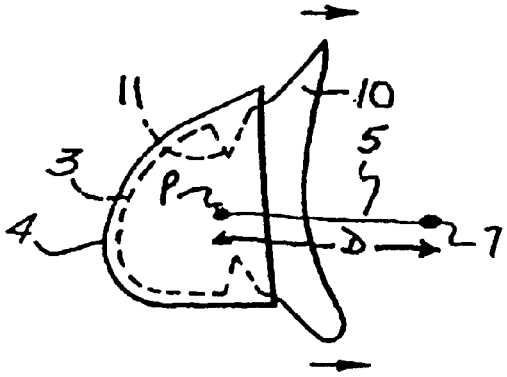
FIG. 2B is a view similar to FIG. 2A but showing the oro-nasal mask in its extended configuration.

As can be seen more clearly from FIG. 2A, the wall of the mask 3 housed within the rigid shell 4 includes extendable means 11 therein. The purpose of the extendable means 11 is to enable the peripheral edge 10 of the mask 3 to move in a direction generally parallel to the wall of the rigid shell 4 when the pressurized breathable gas supplied to the interior of the mask 3 is increased as a result of the regulator 9 being activated when the aircraft makes a turn. When the pressure supplied to the interior of the mask 3 increases, the wall of the flexible mask 3 extends to cope with the increased pressure. As the wall cannot move radially outwardly because it is contained within the rigid shell 4, it can only move in a direction generally towards the pilot's face in the direction of the arrows (see FIG. 2B) and thereby improves its seal therewith.

Figure 3A:
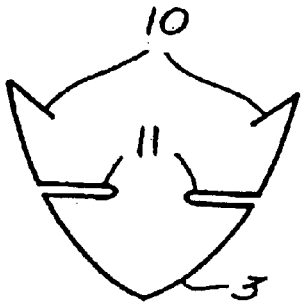
FIG. 3A illustrates schematically the configuration of the oro-nasal mask shown in FIG. 2A prior to a high pressure breathable gas being supplied to the interior thereof.
Figure 3B:
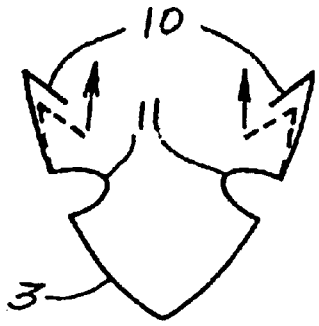
FIG. 3B is a view similar to that shown in FIG. 3A but showing the mask after the high pressure breathable gas has been supplied to the interior thereof and the extendable means extended.

FIG. 3A shows the mask 3 of FIG. 2A in schematic form prior to the breathable gas being supplied to the interior of the mask 3 and with the re-entrant section 17 unextended. FIG. 3B shows the mask of FIG. 3A after the pressurized breathable gas has been supplied to the interior thereof and it can be seen that the re-entrant section has extended and reconfigured to the illustrated shape so the edge 10 of the mask is moved in the direction of the arrows (see FIG. 3B) towards the pilot's face to improve the seal therewith.

Whilst this prior art mask shown in FIGS. 1–3 worked satisfactorily when it was subjected to low to mid range G-forces, it was found that a problem could arise when high G-force turns were made because the high G-forces generated by the turn caused the rigid shell 4 and the oro-nasal mask housed within it to pivot about the mounting point P where the harness 5 is attached to the shell 4. As a result, the peripheral edge seal 10 with the pilot's face could not be maintained and accordingly the high pressure gas supplied to the interior of the mask 3 would leak out so the pilot would be starved of the required amount of breathable gas so he could black out.

Figure 4A:
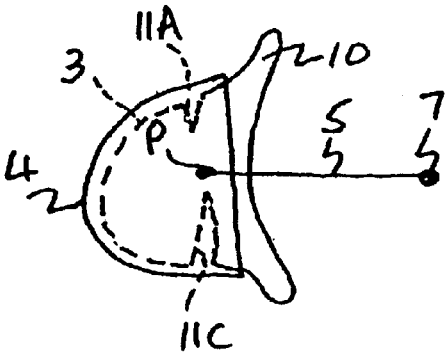
FIG. 4A is a view similar to that shown in FIG. 2A but illustrates the improved oro-nasal mask of the invention.
Figure 4B:
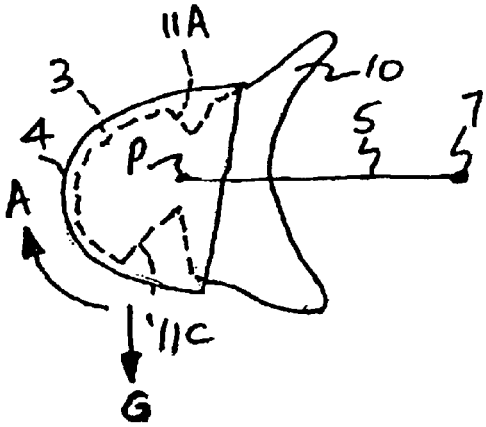
FIG. 4B is a view similar to that shown in FIG. 2B but with the oro-nasal mask of the invention in its extended condition.
Figure 7:
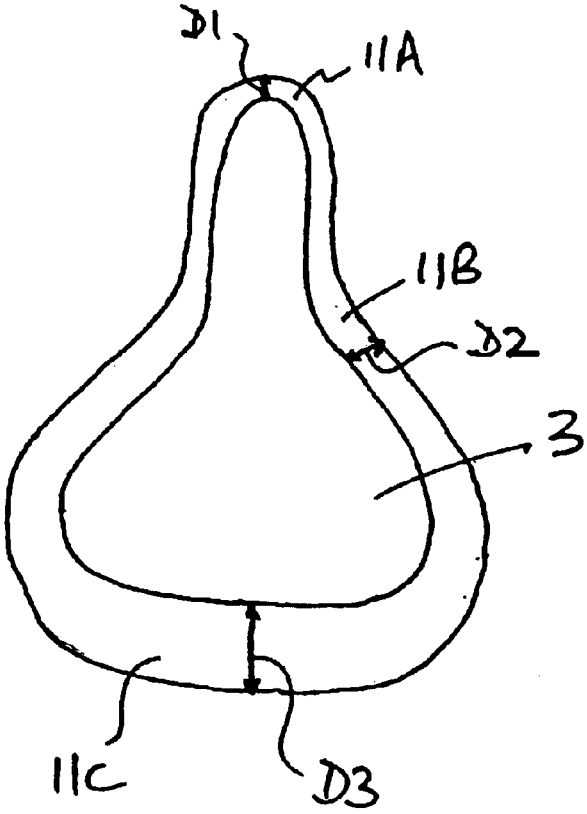
FIG. 7 is a cross section of the oro-nasal mask shown in FIG. 4A taken along the lines VII—VII.

Referring now to FIGS. 4A and 4B, there is shown an improved face mask of the present invention and it can be seen that the re-entrant section 11A in the top portion of the wall of the oro-nasal mask 3 which provides the extendable means is smaller than there-entrant section 11A in the bottom part of the mask than it is in the top. This is better illustrated in FIG. 7 where it can be seen that the width D1 of the re-entrant section 11A at the top of the mask is less than the width D2 of the re-entrant section 11B in the middle region of the mask on either side of the pilot's nose which itself is narrower than the width D3 of the re-entrant section 11B of the mask at the bottom thereof in the chin region. Thus, the dimension D1 is less than D2 which is less than D3.

The effect of providing a variable sized re-entrant section as the extendable means in the wall of the face mask 3 is better shown in FIG. 4B. When the breathable gas at high pressure is supplied to the interior of the mask 3, the extendable means 11 expand because the mask 3 cannot move relative to the shell 4, so the peripheral edge 10 is moved in the direction of the arrows towards the pilot's face. However, because the re-entrant section 11C in the bottom half of the mask 3 is larger than the re-entrant section 11A in the top part of the mask and the edge 10 cannot move significantly further towards the pilot's face, the rigid shell 4 is pivoted upwardly as indicated by the arrow A (see FIG. 4B) thereby compensating for the G-force acting on it which tends to push it downwardly in the direction of the arrow G. Accordingly, it will be seen that when the pilot makes a high G-force turn, the rigid shell 4 is automatically pivoted upwardly as the pressure of the breathable gas supplied to the interior of the mask 3 increases. Thus, the edge seal 10 is maintained with the pilot's face at all times during the turn so he is supplied with the required amount of high pressure breathable gas that he needs to avoid blacking out.

Figure 5A:
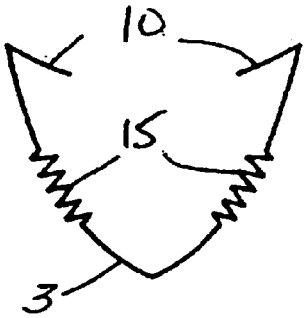
FIG. 5A illustrates schematically an alternative mask of the invention incorporating bellows in the wall thereof prior to a high pressure gas being supplied to the interior thereof.
Figure 5B:
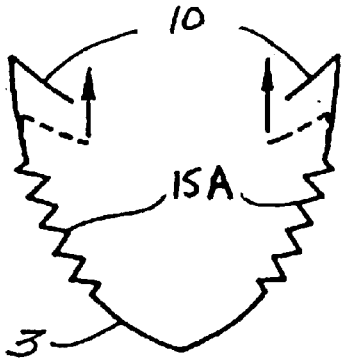
FIG. 5B is a view of the mask shown in FIG. 5A after a high pressure breathable gas has been supplied to the interior thereof.

FIGS. 5A and 5B show another mask configuration which incorporates a bellows section 15 which extends into configuration 15A when a pressurized breathable gas is supplied to the interior thereof thereby causing the edge region 10 to move towards the pilot's face.

Figure 6A:
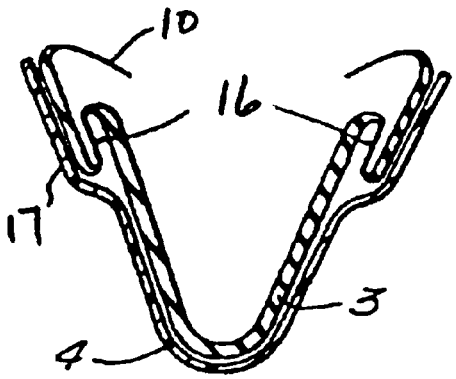
FIG. 6A illustrates schematically another embodiment of mask of the invention incorporating a convoluted rolling section in the wall thereof prior to a high pressure breathable gas being supplied to the interior of the mask.
Figure 6B:
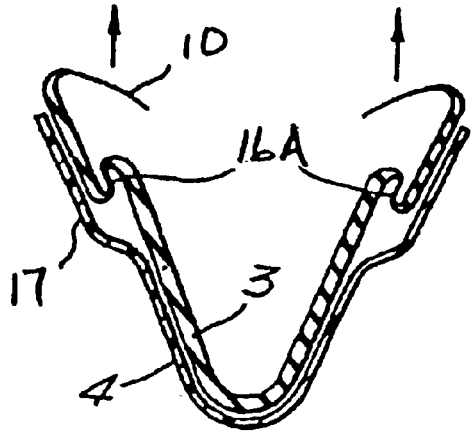
FIG. 6B is a view of the mask shown in FIG. 6A after a high pressure breathable gas has been supplied to the interior of the mask.

In the arrangement shown in FIGS. 6A and 6B, the mask 3 is housed within the rigid shell 4 as has already been described. The mask 3 has a convoluted rolling section 16 which is situated behind and adjacent edge seal 18 and accommodated in an enlarged section 17 of the rigid shell 4. As can be seen from the drawings, the thickness of the wall of the mask 3 in the region of the convoluted rolling section 41 is thinner than the remainder of the mask 3 thereby allowing it to be rolled back on itself into the S-shaped configuration illustrated. In its normal state, the mask 3 is contained within the shell enlargement 17. However, when the pressure of the gas supply to the interior of the mask 3 is increased, the convoluted rolling section 17 tends to unroll and the edge seal 10 is moved in the direction of the arrows thereby increasing the force applied by the edge seal 10 to the pilot's face thus preventing leakage.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A flexible oro-nasal mask for mounting in a rigid shell attached to a helmet of aircrew at a fixed distance therefrom, the flexible oro-nasal mask comprising an inspiratory and expiratory valve and a periphery of the mask being adapted to make a seal with a wearer's face, the oro-nasal mask comprising: an extendable means operable to press the periphery of the mask automatically towards the wearer's face to improve the seal therewith when gas at a pressure above that for normal breathing is supplied to the mask and the extendable means reconfigured as a result thereof, the extendable means being configured so that when the gas is supplied to an interior of the mask, a portion thereof in a bottom region of the mask extends more than a portion in an upper region of the mask so that the bottom of the mask is moved away from the wearer's face by a greater amount in a chin region of the wearer's face than in the nose region of the wearer's face, whereby the mask is capable of pivoting upwardly automatically to compensate for effects of G forces.

2. The mask as claimed in claim 1, wherein the extendable means comprises an annular inwardly directed re-entrant recess formed in a wall of the mask adjacent the periphery, a depth of said recess in the bottom half of the mask being greater than a depth in the top half thereof.

3. The mask as claimed in claim 2, wherein the re-entrant recess is V-shaped and comprises an inwardly directed flange on a front portion of the mask which is attached to a correspondingly dimensioned inwardly directed flange adjacent the periphery on a separate rear portion of the mask.

4. The mask as claimed in claim 1, wherein the extendable means comprises a plurality of annular inwardly directed recesses formed in a wall of the mask to provide a bellows therein.

5. The mask as claimed in claim 1, wherein a wall of the mask includes a convoluted rolling section, a thickness of the mask wall in a region of the convoluted rolling section being less than a thickness of the mask in a remainder of the mask thereby allowing the mask to be rolled back on itself into an S-shaped configuration.

6. A breathing apparatus for use with a helmet, comprising:

(A) a rigid shell;

(C) an inspiratory valve; and (B) a flexible oro-nasal mask coupled to the rigid shell and coupled to the inspiratory valve, and having a chin region, a nose region, and a periphery adapted to make a seal with a human face, the flexible oro-nasal mask being adapted to reconfigure as a result of gas at a pressure above that for normal breathing being supplied to an interior of the mask through the inspiratory valve, such that a portion of the oro-nasal mask in the chin region extends further from the helmet than a portion of the oro-nasal mask in the nose region;

whereby the periphery automatically presses against a wearer's face to improve the seal therewith, and the mask pivots upwardly automatically to compensate for the effects of G forces.

7. The breathing apparatus as claimed in claim 6, wherein the flexible oro-nasal mask comprises an annular inwardly directed re-entrant recess formed in a wall of the mask adjacent the periphery, a depth of said recess in a bottom half of the mask being greater than a depth in a top half thereof.

8. The breathing apparatus as claimed in claim 7, wherein the re-entrant recess is V-shaped and comprises an inwardly directed flange on a front portion of the mask which is attached to a correspondingly dimensioned inwardly directed flange adjacent the periphery on a separate rear portion of the mask.

9. The breathing apparatus as claimed in claim 6, wherein the flexible oro-nasal mask comprises a plurality of annular inwardly directed recesses formed in the a wall of the oro-nasal mask to provide a bellows therein.

10. The breathing apparatus as claimed in claim 6, wherein a wall of the oro-nasal mask includes a convoluted rolling section, a thickness of the oro-nasal mask wall in a region of the convoluted rolling section being less than a thickness of a remainder of the mask thereby allowing the mask to be rolled back on itself into an S-shaped configuration.

11. The breathing apparatus of claim 6, further comprising an attachment to maintain the mask a fixed distance from the helmet.

* * * * *